US007789079B2

(12) United States Patent
Harbert

(10) Patent No.: US 7,789,079 B2
(45) Date of Patent: Sep. 7, 2010

(54) ENCLOSED ROCKER ARM COVER ASSEMBLY HAVING INTERNAL MULTI-COIL MOUNTING PLATE

(76) Inventor: Richard H. Harbert, 6700 Waterton Cir., Mukilteo, WA (US) 98275

( * ) Notice: Subject to any disclaimer, the term of this patent is extended or adjusted under 35 U.S.C. 154(b) by 449 days.

(21) Appl. No.: 12/026,269

(22) Filed: Feb. 5, 2008

(65) Prior Publication Data

US 2008/0121199 A1 May 29, 2008

Related U.S. Application Data

(63) Continuation-in-part of application No. 11/336,710, filed on Jan. 20, 2006, now Pat. No. 7,350,488.

(51) Int. Cl.
*F02P 3/02* (2006.01)
*F01M 9/10* (2006.01)

(52) U.S. Cl. ..... 123/635; 123/90.38; 123/647

(58) Field of Classification Search ..... 123/90.38, 123/195 C, 198 E, 634, 635, 647
See application file for complete search history.

(56) References Cited

U.S. PATENT DOCUMENTS 5,003,958 A * 4/1991 Yoneyama et al. ..... 123/635
5,323,745 A 6/1994 Sato et al.
6,494,193 B2 12/2002 Weingaertner et al.
6,622,711 B1 9/2003 Skinner et al.
7,350,488 B2 4/2008 Harbert
2008/0121199 A1* 5/2008 Harbert ..... 123/90.38
2009/0241879 A1* 10/2009 Harbert ..... 123/90.38

FOREIGN PATENT DOCUMENTS

JP 2003293854 A * 10/2003

* cited by examiner

*Primary Examiner*—Willis R Wolfe, Jr.
(74) *Attorney, Agent, or Firm*—Jacques M. Dulin, Esq.; Innovation Law Group, Ltd.

(57) ABSTRACT

An improved rocker arm cover assembly having an upper coil chamber that is enclosed and a lower rocker arm chamber that includes special seal and flange members to isolate it from the engine head. The fully enclosed upper coil chamber includes a mounting plate on which a plurality of coils is mounted. A fully isolated, dual function, oil fill/PCV valve, conduit is provided through the upper chamber to permit adding lubrication oil or permitting exhaust of crankcase vapors without contaminating the coils. Several variations of coils and coil mounting brackets are disclosed.

20 Claims, 8 Drawing Sheets

ENCLOSED ROCKER ARM COVER ASSEMBLY HAVING INTERNAL MULTI-COIL MOUNTING PLATE

CROSS REFERENCE TO RELATED APPLICATIONS

This application is a Regular US Continuation-in-Part of parent U.S. Regular application Ser. No. 11/336,710 filed by the same inventor on Jan. 20, 2006, entitled ROCKER ARM COVER, published as Patent Publication US-2007-0169734-A1 on Jul. 26, 2007, now U.S. Pat. No. 7,350,488, issued Apr. 1, 2008. The priority of said prior application is claimed under 35 US Code Section 120 ff.

FIELD

The invention relates to the field of automotive parts, and more particularly to an improved rocker arm cover assembly having an upper coil chamber that is enclosed and a lower rocker arm chamber that includes special seal and flange members to isolate it from the engine head. The fully enclosed upper coil chamber includes a plate on which a plurality of coils is mounted. A fully isolated dual function conduit is provided through the upper coil chamber to the lower rocker arm chamber to either function as an oil fill tube to permit adding lubrication oil without contaminating the coils or as a crankcase vapor exhaust to the air intake manifold via a PCV valve fitted in the conduit. A plurality of coil and coil mounting brackets are disclosed.

BACKGROUND

Conventional after-market valve covers or rocker arm covers (RACs) comprise a thin sheet metal or plastic cover mounted on the engine head(s). These covers have a single cavity that encloses the rocker arms, valve return springs and pushrods that together actuate the cylinder valve stems. In more recent model engines equipped with a Distributorless Ignition Systems (DIS), a plurality of ignition coils, one for each cylinder in the engine, are mounted in association with the head. For the typical V8 engine, two rocker arm covers are employed, one for each bank of 4 cylinders.

Several approaches have been tried for mounting of the coils in a manner to not interfere with the cover. In Weingaertner U.S. Pat. No. 6,494,193, for example, a stepped design for a straight-4 engine is employed wherein a large shallow-height base case covers both the rocker arms and the spark plugs. There is a smaller elevated casing atop the base that contains the coils. Leads are embedded in the plastic and oil-proof boots must be used to connect the leads to the plug. This approach suffers the serious disadvantage of having no separate oil fill, requires removal of 13 bolts to remove the base cover to access the plugs, and it houses the plugs and boots in the "wet" zone, the same space as the rocker arms, where they are continuously exposed to oil and hydrocarbon vapors.

Skinner U.S. Pat. No. 6,622,711 also uses a large cover over the plugs and a separate coil cassette (container) that fits within the large cover directly over the plugs. The coils connect to the plugs via boots as in Weingaertner. Although the engine is only shown schematically, and as a straight 4, the large cover is co-extensive with the head, so the coils are in the wet zone, albeit within a separate cassette. To access the coil cassette, 16 bolts and the large cover have to be removed.

Sato U.S. Pat. No. 5,323,745 shows a single, plastic rocker arm cover over dual camshafts and valve stems with an oil/gas separation chamber mounted on the underside of the cover. The plugs are in the wet chamber defined by the cover and a coil arrangement is not disclosed, so it appears this patent is directed to a distributor-type ignition system.

Industrie Magneti Marelli in EP Application 0-512-357-A2 (Nov. 11, 1992) provides "plug-top" ignition coils located in a 2-part housing comprising upper and lower flanged housings that are bolted together (apparently 16 bolts) at the flanges. The coils are located in the housing. Projecting from the bottom is a boot that fits over the spark plugs. The top housing includes 4 caps, each providing input lead access to the coil below. This unit is independent of a rocker arm cover and rides on the plugs themselves, rather than being separately mounted, so the unit puts weight and torsional strain on the plugs.

As can be seen from such exemplary unsatisfactory designs, there is a long felt but unmet need in the art for a cleaner, tidier rocker arm and coil assembly that prevents cross contamination, yet provides full and independent access for replacement and servicing, is robust under severe service conditions, has a useful life far longer than stamped sheet metal or plastic, and is simple and faster to install.

THE INVENTION

Summary, Including Objects and Advantages

The invention is directed to an improved rocker arm cover (RAC) for internal combustion engines, and more particularly to an over-under design in which coils are placed above the rocker arms exposed above the engine heads. The exemplary rocker arm cover of this invention is described in reference to a 4-cylinder bank of a V-8 engine, so that there are two complementary rocker arm covers employed for each such V-8 engine.

The inventive RAC comprises a single, generally elongated, open bottom housing having a plurality of parts and features. In plan view, the housing is generally rectangular with rounded ends, classified as "stadium" shaped, and in vertical cross-section is generally an inverted-U shape and has a generally horizontal partition wall spanning between the vertical side walls approximately half way between the top and the open bottom. The housing may be made of aluminum or a rugged plastic or composite composition of the type used in automotive applications in conjunction with engine compartments, and is preferably aluminum such as Alcoa 7075-2 aircraft aluminum, or a carbon-fiber composite.

The housing comprises an upper, coil chamber, the bottom of which is a solid transverse partition web that forms the top wall of the lower rocker arm chamber. The housing is open at the bottom to fit over the engine head. The exterior vertical wall of the housing is continuous and terminates at a lower margin in a groove that receives a seal member, which in a preferred embodiment is a flanged O-ring. Approximately half of that lower margin terminates in an internal, vertically downwardly extending lip, lying inside the O-ring seal, that engages a corresponding groove or shoulder of the engine head. That lip provides an alignment function that insures the inventive RAC is properly fitted on the head before the securing bolts are inserted and tightened.

The transverse web includes a plurality of mounting bosses having recessed holes that permit insertion of the mounting bolts to secure the RAC to the head. Preferably, these bosses project downwardly from the underside of the transverse web. That is, the bosses project into the rocker arm chamber, while the recesses are accessible from the upper coil chamber. Thus, the RAC is secured to the head internally of the housing.

In addition the upper coil chamber is horizontally sectioned into two portions, an upper lid half and a lower coil-retaining-bracket half. The use of the coil bracket plate means that only two bosses need be provided projecting upwardly from the transverse web. The bracket is secured to these two bosses, one generally at each end. Thus the entire coil assembly can be assembled separately on the bench, and then placed as a group into the RAC upper coil chamber. The preferred embodiment of the coil bracket orients the coils at about a 60 degree angle with respect to the longitudinal axis of both the inventive RAC assembly and the bracket. This permits use of coils with long tubular spark plug wire sockets. In a second embodiment, the bracket is configured for orthogonal placement of the coils. In each embodiment, only two screws are required to secure each coil in place.

The lid is secured to the bracket with two screws, that can be threaded into holes in the bracket at any convenient location. In the preferred embodiment, the lid screws and bracket holes are adjacent opposite longitudinal ends, but may be medial thereof or additional screws may be used as one skilled in this engineering art deems advisable. Note that the lid is thus secured to the coil bracket, which in turn is secured to the two bosses projecting upwardly from the transverse chamber-defining web. As a result, the lid can be removed and the coils serviced or changed-out without having to disturb the seal and the rocker arm chamber.

The upper coil chamber has five coil apertures; four are on the side facing the spark plugs and one, typically spaced medially of the ends of the RAC housing, for the inlet ignition lead(s) to the coils. Since the rocker arm chamber is isolated, the four apertures from which the coil spark plug wire sockets project (or through which they are accessible) need not be fully sealed. However, it is preferred to provide a soft grommet to seal between the aperture margin and the coil socket to prevent infiltration of dust, grime, etc.

The inventive RAC pair for each engine may be alike, in which case in one of the two covers, a port or conduit is provided extending from the exterior surface of the lid and communicating with the rocker arm chamber. This conduit is adapted with an internal tang and a bayonet cap to function as an oil fill port. The other variation of the RAC unit conduit is adapted with a flange and fitted with a standard Positive Crankcase Ventilation valve (PCV valve) instead of the cap for pressure balance ventilation of the crankcase. The output of from the PCV valve is connected by a vacuum hose to an input in the air intake manifold. In this preferred embodiment (the two variations of the conduit), the passenger side RAC unit of the invention is the oil fill port and cap version which is oriented at the front of the engine, while the PCV valve version is oriented with the conduit and PCV valve adjacent the firewall. Alternately, the RAC unit castings may be mirrored, that is, chiral orientation of the parts with respect to each other. Stated another way, there may be a Left handed RAC and a Right handed RAC, so that the oil fill cap version and the PCV version are both oriented toward the front or the back of the engine.

The oil fill/PCV valve conduit is an important feature of the improved RAC. The conduit extends from the top, outer surface of the lid to the bottom of the transverse web, thus providing an isolated conduit for introduction of lubricating oil directly into the rocker arm chamber or the exhaust of blow-by vapors and pressure in the crankcase, as the case may be. The conduit has an upper portion cast or fitted into the lid that matingly engages, e.g., by groove and shoulders, a lower portion that projects up from the transverse web to engage the upper tube portion. The conduit is closed by a cap for the oil fill version and by a standard PVC valve in the crankcase vent version. It is preferred that a bayonet and groove assembly be used for the oil fill cap, and in the preferred embodiment, the cap includes a groove in its stem while the interior surface of the tube includes a tang that engages the bayonet groove of the cap. The cap also includes a seal member, preferably an O-ring.

An important aspect of the inventive RAC assembly is the provision of the parting (join) line between the lid and the lower half of the coil chamber generally bisects, horizontally, the coil socket apertures on the first longitudinal wall and the inlet hole for the current feed wire on the opposed, longitudinal wall. In that way, the lid can be lifted off and the individual coils removed, or the entire coil bracket with coils still attached, by straight vertical lift out. That is, the apertures are not either in the side wall below the join line, or above the join line in the lid, as if they were, the removal for replacement or servicing would require unthreading and rethreading of the spark plug and feed wires. This "lift-off" for service functionality is an important feature of the split aperture design of the inventive RAC assembly.

Accordingly, the inventive RAC includes multiple functionalities that cooperate to provide complete, but independent access to the various engine parts needing service or replacement independent of each other, with each isolated from the others. The oil fill cap can be removed and oil added without taking off the coil cover. The coil cover can be taken off and either individual coils serviced or replaced, or the entire multi-coil subassembly removed by unscrewing the mounting bracket, and either of those functions accomplished without removing the rocker arm housing from the head. Or the housing removed (in two steps) without disturbing the coil layout, for access to the rocker arms.

BRIEF DESCRIPTION OF THE DRAWINGS

The invention is described in more detail with reference to the seven sheets of line drawings, in which.

DETAILED DESCRIPTION, INCLUDING THE BEST MODES OF CARRYING OUT THE INVENTION

The following detailed description illustrates the invention by way of example, not by way of limitation of the scope, equivalents or principles of the invention. This description will clearly enable one skilled in the art to make and use the invention, and describes several embodiments, adaptations, variations, alternatives and uses of the invention, including what is presently believed to be the best modes of carrying out the invention.

In this regard, the invention is illustrated in the several figures, and is of sufficient complexity that the many parts, interrelationships, and sub-combinations thereof simply cannot be fully illustrated in a single patent-type drawing. For clarity and conciseness, several of the drawings show in schematic, or omit, parts that are not essential in that drawing to a description of a particular feature, aspect or principle of the invention being disclosed. Thus, the best mode embodiment of one feature may be shown in one drawing, and the best mode of another feature will be called out in another drawing.

All publications, patents and applications cited in this specification are herein incorporated by reference as if each individual publication, patent or application had been expressly stated to be incorporated by reference.

Figure 1:
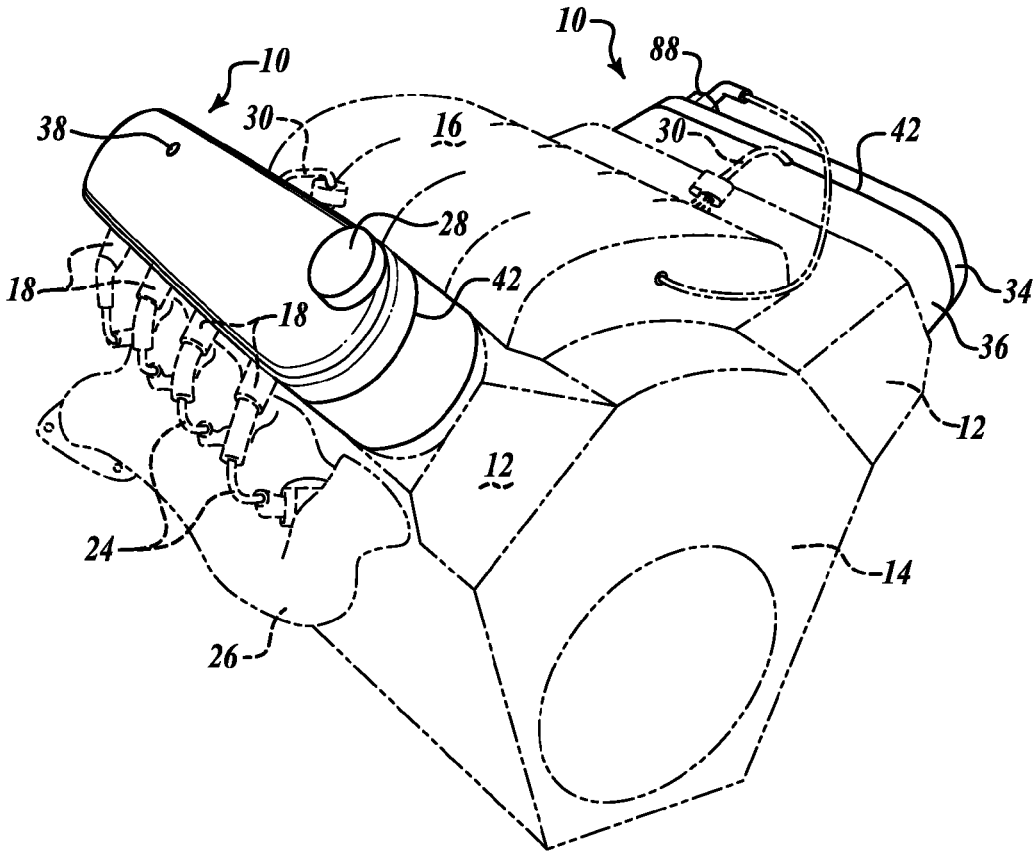
FIG. 1 is an isometric view from the front right side of an engine showing two inventive RAC assemblies in use context as mounted on the two heads of a V8 engine.

FIG. 1 shows in isometric a pair of the inventive RAC assemblies 10 in their use context mounted on the heads 12 of a V8 engine 14 on either side of the air intake manifold 16. As shown, the nozzles 18 of the coils project out through apertures on the outboard side of the inventive RAC assembly 10. Spark plug wires 22 are fitted in the nozzles and connect to the spark plugs 24, visible between the arms of the exhaust manifold 26. One end of the RAC unit 10 is fitted with an oil filler cap 28. The power supply and ground wire input lead 30 is shown feeding into the inboard side of the inventive RAC assembly 10. The air intake manifold 16 is preferably fitted with a port to receive a vapor input line from the output end of the PCV valve (see FIG. 3B).

The inventive RAC assembly 10 comprises a rectangular housing having a continuous vertical side wall 32 that is rounded at each end to form, in plan view, a stadium shape. The vertical side wall 32 has a horizontal parting line 42 that divides the RAC into a lid 32 that fits over the main body 36. The lid is secured to the main body by inset threaded fasteners 38.

Figure 2:
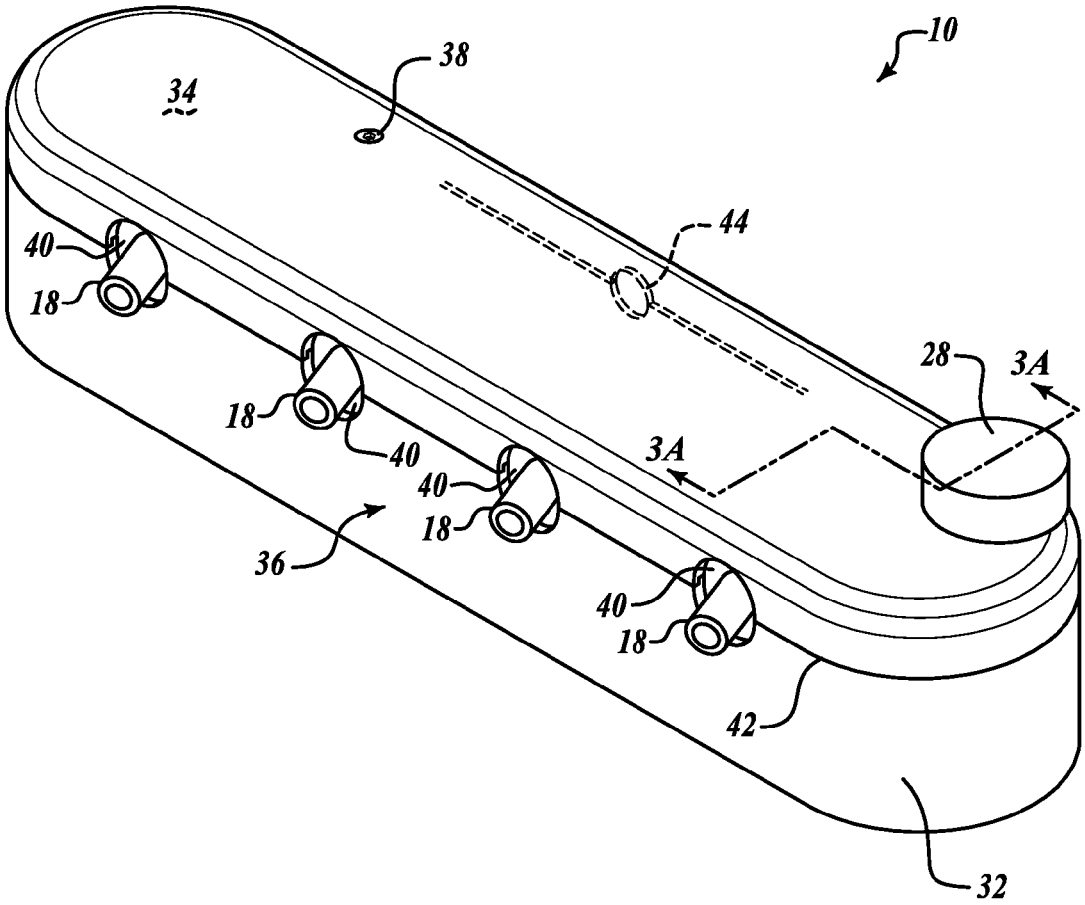
FIG. 2 is an isometric view from the spark plug side of the inventive RAC assembly showing the four coil socket holes in the vertical longitudinal side wall and the oil fill tube cap in place.

FIG. 2 shows a RAC unit in isometric, rotated to show the detail of the coil nozzles 18 projecting through the outboard side wall apertures 40. Note that the parting line dividing the unit into the lid 34 from the main body 36 bisects, horizontally, the apertures 40, and the power supply wire aperture 44 in the inboard side wall opposite the coil apertures.

Figure 3A:
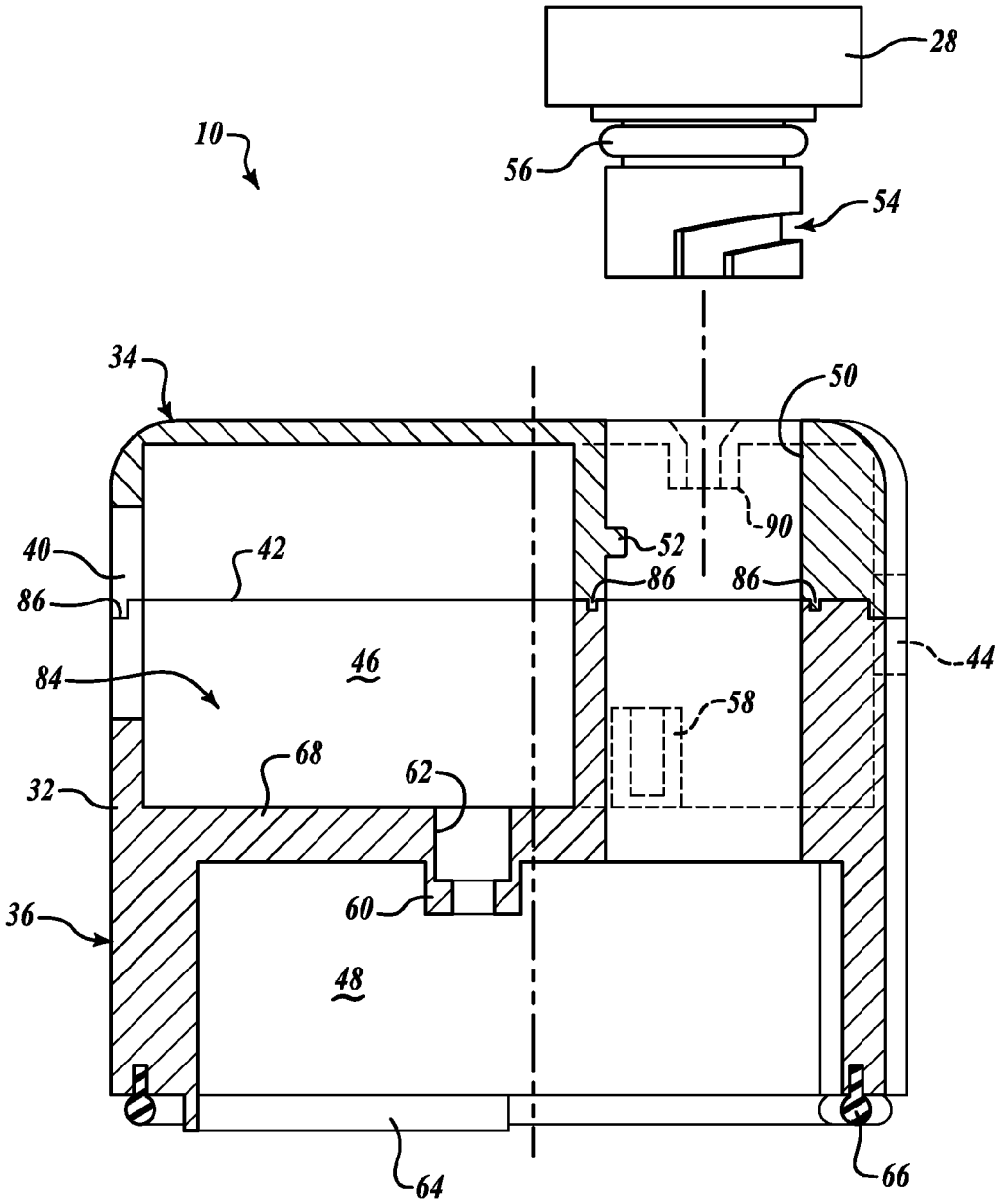
FIG. 3A is a vertical transverse partial section, partial exploded view through the inventive RAC assembly of FIG. 1 along the lines 3-3 showing the oil fill conduit and tang version, and showing the oil fill tube closure cap having a bayonet groove for engaging the tang and O-ring seal assembly.
Figure 3B:
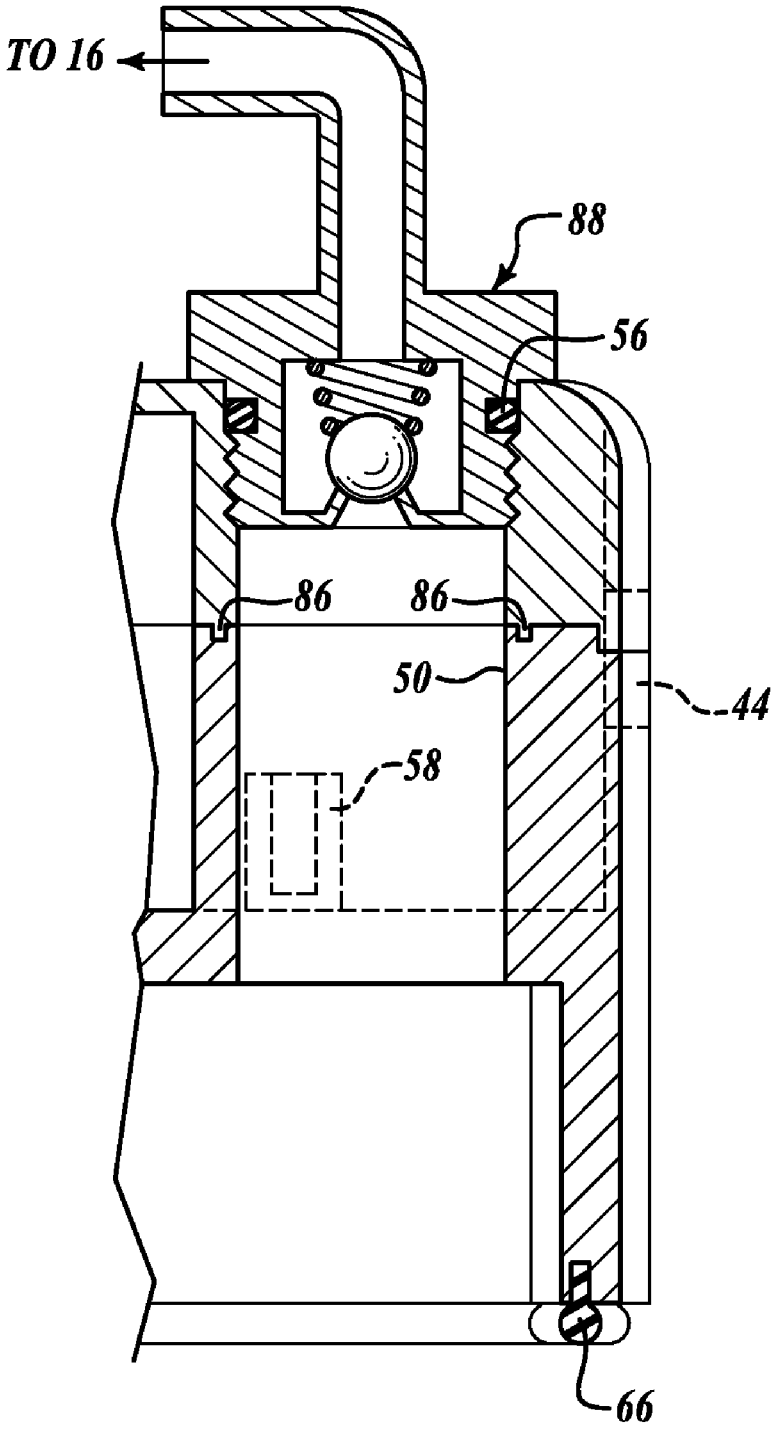
FIG. 3B is a vertical partial section in the same orientation as FIG. 3A showing the PCV valve version of the inventive RAC unit.

FIGS. 3A and 3B are transverse section views along the line 3-3 of FIG. 2 showing the two versions of the conduit 50. In both, the upper coil chamber 46 is divided into the lid 34 and the recess 84 in which a coil mounting bracket is secured (see FIG. 4). Below the coil chamber 46 is the rocker arm chamber 48 which is isolated by the horizontal partition wall 68 that extends transversely between all upstanding vertical side walls 32. Note the oil fill tube version of FIG. 3A includes a removable oil filler cap 28 that sealingly plugs the oil filler tube 50, and is maintained in place by tang 52 in the tube side wall engaging the bayonet groove 54 in the cap. The tang draws the cap down tight so the O-ring seal 56 engages the side wall of the oil filler tube 50.

In the PCV valver version of FIG. 3B a standard PCV valve 88 is screwed into threaded conduit 50. Typically, AN-10 or AN-12 fuel or breather system type threads may be used. An optional O-ring 56 may be used to sealingly engage the conduit 50. The standard PCV valve includes a ball valve and a biasing spring so that blowby and vapors from the crankcase, via the RAC chamber are sucked out of the crankcase, via the rocker arm chamber, the conduit 50, and the PCV valve 88, to be input into the air intake manifold (standard vacuum line shown schematically in FIG. 1), where the vapors are mixed with the air/fuel mix for combustion in the cylinders.

Figure 4:
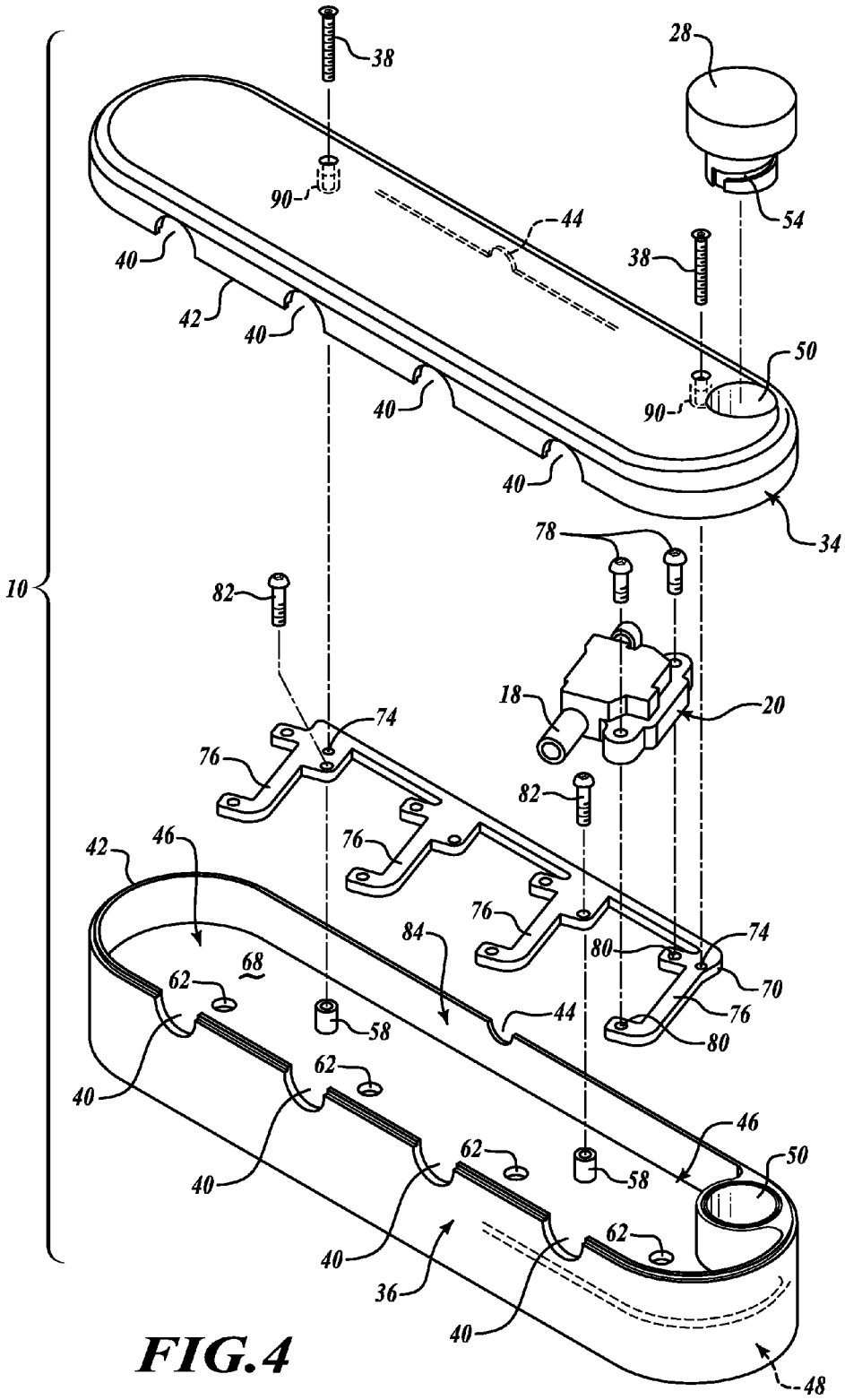
FIG. 4 is an exploded view of the entire inventive RAC assembly showing the lid, the coil bracket, one coil, the base housing, the securement bolts and the oil fill tube cap.

The upper face of the partition wall 68 is provided with a pair of vertical threaded bosses 58 to which the coil bracket is secured (see FIG. 4). In addition, four bosses 60 are provided projecting downwardly from the lower face of the partition wall 68. The bosses include a recess 62 in the partition wall communicating with the unthreaded holes through those bosses to receive mounting bolts for securing the inventive RAC assembly unit to the head 12 of engine 14. Note that the mounting bolts are thus inside the enclosed RAC assembly. The lid is bolted to the coil bracket via bolts 38 which pass through the holes in bosses 90 formed in the underside of the lid.

A partial lip 64 extending downwardly from the open bottom of the rocker arm chamber 48 spans from one short transverse (curved) end wall 32, along the outboard wall and terminates in a corresponding location at the other transverse end wall. This lip engages a groove in the head, assisting in centering the RAC assembly properly on the head. In addition a flanged sealing ring 66 is fitted in a groove in the bottom wall 32 all the way around the rocker arm chamber to prevent oil leak. Thus, in the inventive RAC assembly, the "wet" rocker arm chamber 48 is isolated from the "dry" electronic coil chamber 46, yet oil can be added through the oil filler tube that communicates from the exterior top surface of the lid 34 by removal of the cap 26.

FIG. 4 shows in exploded view all of the parts of the inventive RAC assembly 10 (oil fill cap version). In addition to the parts called out above it can be seen that the coils 20 (only 1 shown for simplicity) are secured to the bracket 70 by screws 78 fastened to threaded holes 80 2 per coil. In turn the multi-coil bracket 70 is secured to the bosses 58 by screws 82. Thus, only 2 screws are needed to secure all 4 coils into the coil chamber. This permits the coils 20 to be assembled to the bracket 70 in advance. The bisected apertures 40 and 44 permits the entire assembly, including coils, spark plug wires and lead wire to be lifted out of the RAC assembly, or placed in it after the body has been bolted down by bolts fitted in the recesses 62 and secured to the head. Note that then the two lid screws 38 are fitted through bosses 90 and secured into the threaded holes 74 in the bracket; again, only 2 screws are needed. Since the lid can be removed for access to the dry coil chamber without disturbing the wet rocker arm chamber, the coils can be serviced independently of the rocker arms.

Figure 5:
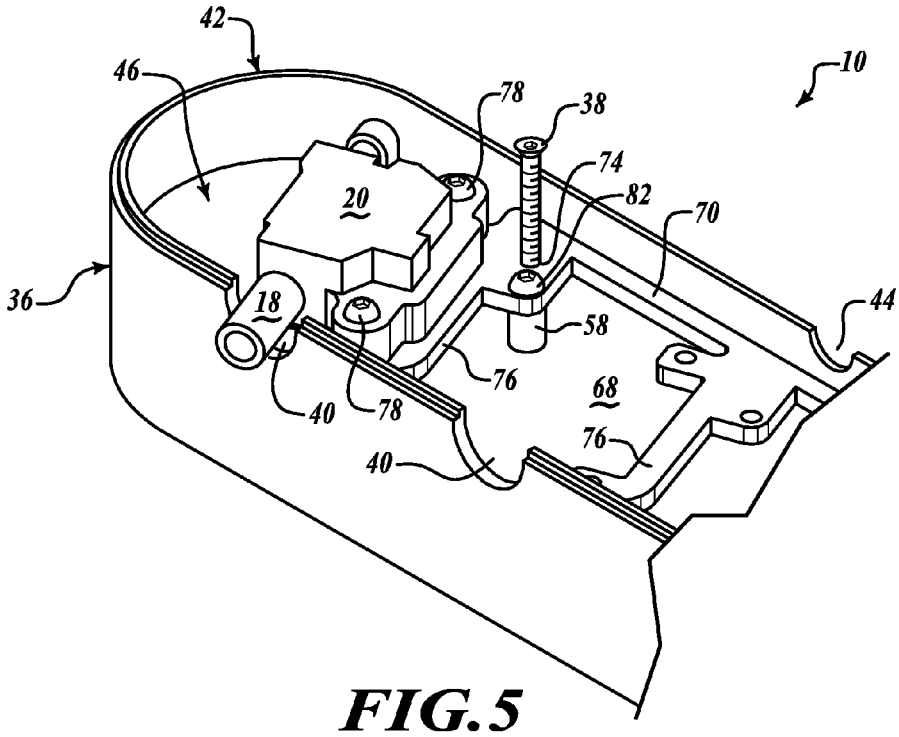
FIG. 5 is an isometric close-up of a first, preferred embodiment of a coil mounted on an angle bracket in the coil chamber.
Figure 6:
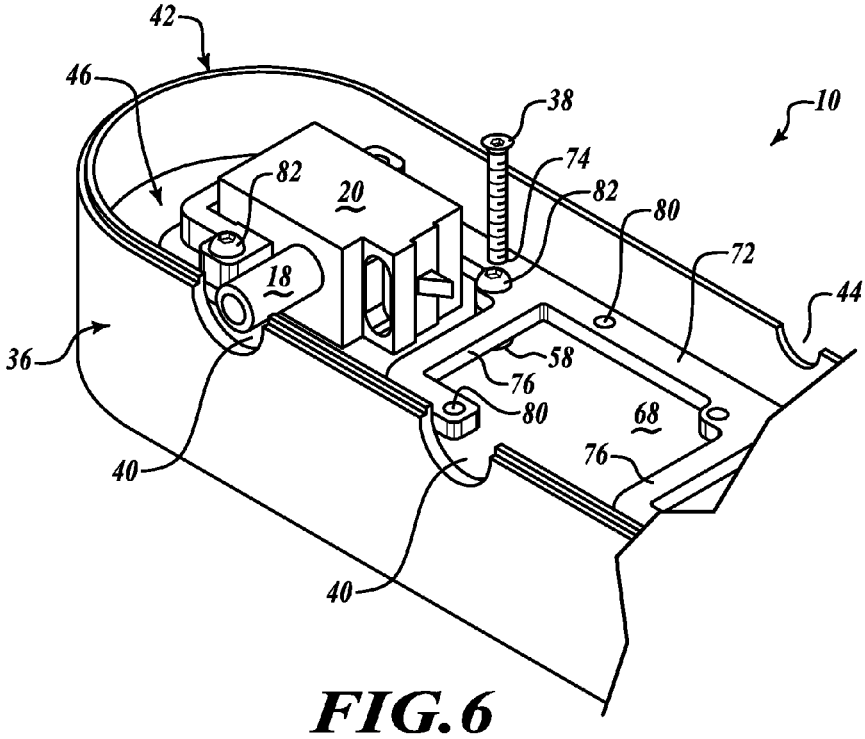
FIG. 6 is an isometric close-up of a second embodiment of a short coil mounted on an orthogonal bracket in the coil chamber.

FIGS. 5 and 6 show two variations in the coil bracket, FIG. 5 showing an angled bracket, that is a first version 70 with the arm 76 angled to permit use of a coil 20 that has a long nozzle 18, while FIG. 6 shows a second version 72 in which the arms are orthogonal to the longitudinal backbone of the bracket for use with short nozzle coils 20.

Figure 7:
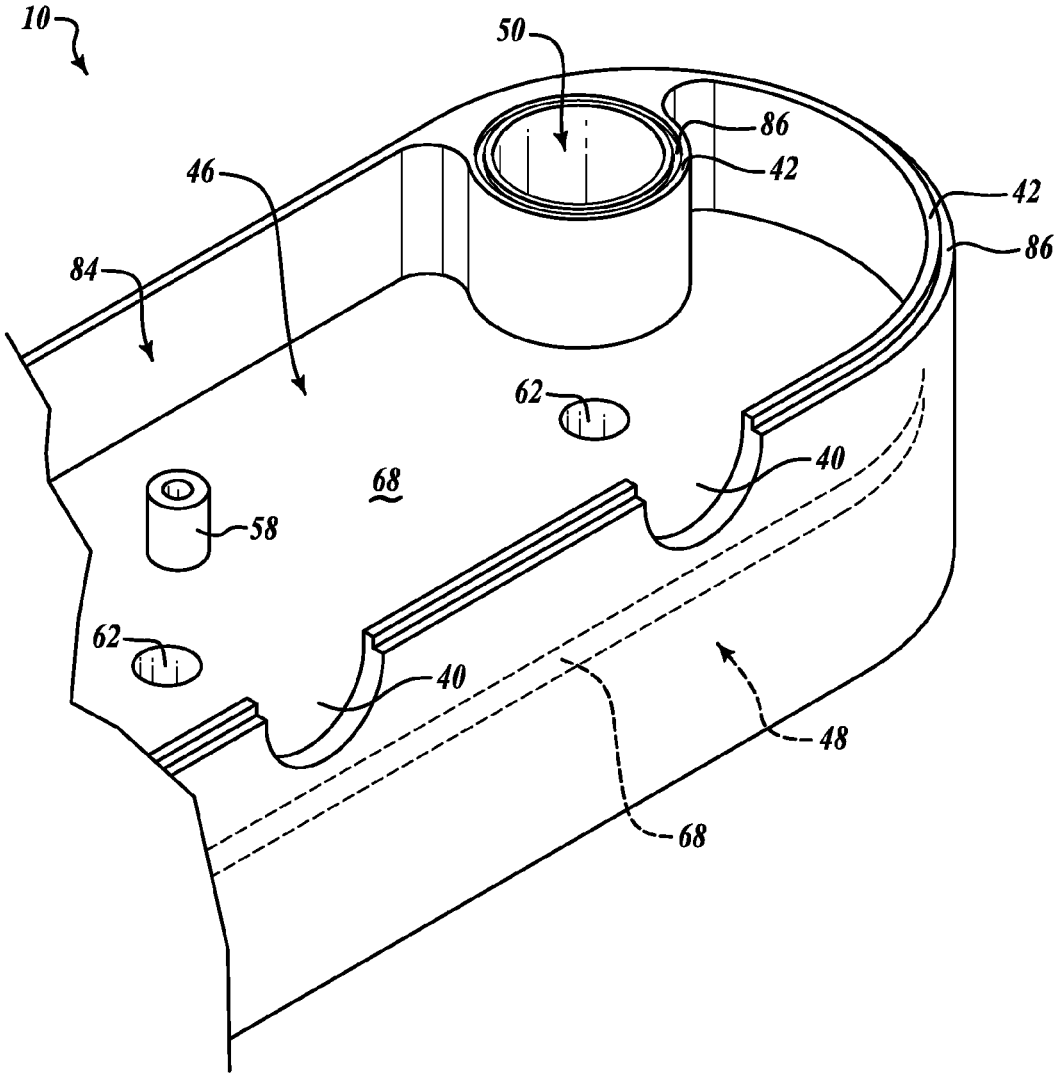
FIG. 7 is an isometric close-up of the oil fill tube section extending through the lower half of the coil chamber.

FIG. 7 is an isometric of the dual function conduit 50 (oil fill and PCV valve vapor conduit) as it passes through the recess 84 of the coil chamber 46. As shown, the tube is machined out of mono-block aluminum. The conduit sealing groove 86 is shown (see also FIG. 3); for the oil filler tube/PCV valve version the seal is a groove. Note that for the outer wall the seal 86 comprises a pair of mating shoulders in the lid and main body, respectively.

Figure 8:
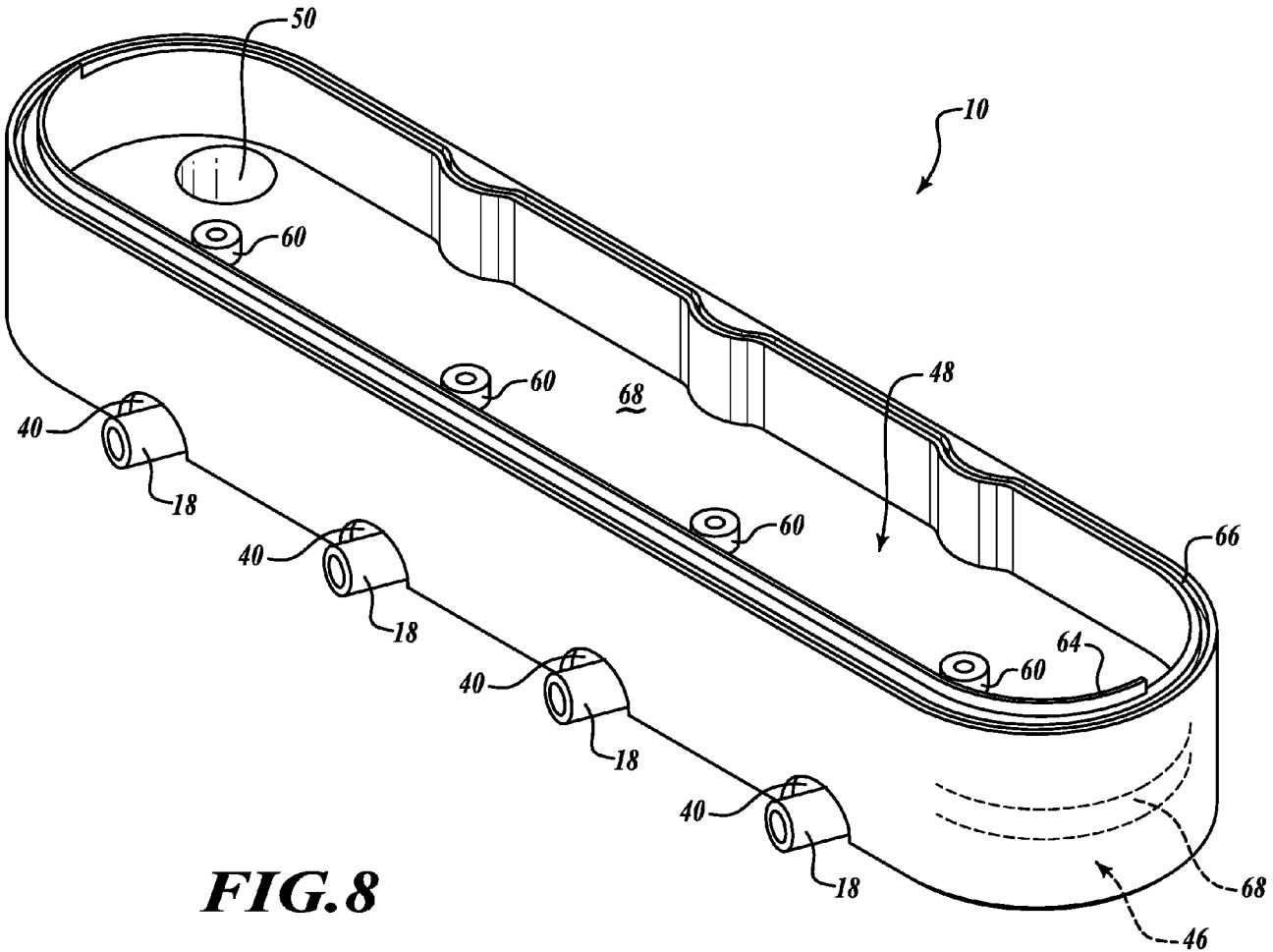
FIG. 8 is an isometric of the underside of the inventive RAC assembly housing showing the rocker arm chamber, the centering lip and the seal member in the peripheral groove.

FIG. 8 is an isometric view of the underside of the inventive RAC assembly 10 showing the rocker arm chamber 48. The oil filler/PCV valve vapor tube 50 exits at the horizontal partition wall 68 of that chamber. The four bosses 60 for the bolts to mount the RAC assembly to the head are shown. Comparing this figure to FIG. 3A the extent of the partial lip 64 is clear, as is the flanged sealing ring 66.

Thus, the invention is directed to an improved, enclosed combined ignition coil and RAC assembly for internal combustion engines having Distributorless Ignition Systems, that is mountable to the head of an internal combustion engine, comprising an elongated, longitudinally extending, open-bottom shell housing, having generally an inverted-U shape in vertical cross-section, a pair of spaced, vertical, longitudinally extending side walls that are joined at each end by end walls that are continuations of and join the respective side walls, the bottom of said side walls being configured to sealingly engage the head of an internal combustion engine in mounted position; the shell housing has a horizontal partition wall spanning between said verti-cal side walls and is disposed medially between the open bottom and a flattened top of said hou-sing; the partition divides the housing into an upper coil chamber and a lower rocker arm chamber to provide an enclosed "coil-over" mounting arrangement; the upper coil chamber is divided into a removable lid member and a coil mounting recess along a parting line disposed medially between the horizontal partition and the under surface of the lid; the upper coil chamber includes a plurality of apertures in one longitudinal side wall through which plug wires may be fed to coils mounted in said coil chamber; a coil mounting bracket configured to receive a plurality of coils mounted in generally parallel relationship thereon in said coil chamber recess so that coil sockets can be directly accessed and engaged with plug wires through the side wall apertures; the side wall apertures being disposed in said side wall so that said apertures are substantially horizontally and medially split by said partition line such that approximately half the aperture is in the lid and half is in the coil recess side wall above said horizontal partition wall; a pair of upstanding bosses disposed extending upwardly from said horizontal partition wall adjacent opposed longitudinal ends of said coil mounting recess, said bosses being threaded to receive mounting screws for securing said coil mounting bracket thereto; a conduit extending from an aperture in said lid through said coil chamber and exiting through said horizontal partition, which conduit is isolated from said coil chamber and provides the dual function of an oil fill tube or a crankcase vapor exhaust.

1. Additional features include the lid having a plurality of mounting holes and mounting screws, and the coil bracket has the same plurality of holes corresponding to and aligned therewith for receiving said mounting screws so that said lid is secured to said coil bracket. The horizontal partition wall includes a plurality of holes for receiving mounting bolts, which holes are cooperatingly aligned with threaded mounting holes in the engine head so that the inventive RAC assembly is mountingly secured to said head by bolts through said holes in said partition wall. The rocker arm chamber side of the horizontal partition wall includes bosses through which the assembly mounting holes pass. The partition line includes cooperatingly aligned lip and shoulders in the side walls of said lid and said coil recess to provide alignment and seal. The marginal edge of the open bottom of the inventive RAC housing includes a groove for receiving a seal member to assist in sealing said assembly to said engine head. A lip is provided, depending from at least a portion of the marginal edge of the open bottom to assist in alignment of the inventive RAC assembly to the engine head. The assembly alignment lip extends along at least a portion of the bottom marginal edge of the vertical side wall in which said apertures are located. The said lip extends at least part way around the transverse end walls joining said longitudinal side walls. An aperture is provided in the vertical side wall for in-feed of signal or power to said, and the in-feed aperture is preferably disposed in the coil chamber side wall opposite the plurality of coil socket apertures. Also, the in-feed aperture is preferably horizontally split by said parting line. In one version of the inventive RAC the conduit comprises an oil fill tube and which includes a closure cap having a stem for sealingly engaging said oil fill tube to permit adding oil directly to said rocker arm chamber without removal of said coil chamber lid. Preferably, the oil fill tube includes a tang that cooperatingly engages a bayo-net slot in said cap stem to cammingly tighten said cap down onto the top of said cover assembly, and said cap includes an O-ring seal that sealingly engages a shoulder adjacent the inlet end of said oil fill tube. In a second version the conduit comprises a crankcase vapor passage the RAC unit includes a PCV valve communicating with an air intake manifold of said engine. Preferably, the crankcase vapor passage conduit includes a shoulder and lip to which said PCV valve is sealingly engaged by an O-ring.

INDUSTRIAL APPLICABILITY

It is clear that the inventive RAC assembly of this application has wide applicability to the automotive industry, namely to engines having Distributorless Ignition Systems. The inventive RAC assembly clearly provides simplicity of mounting and independent access of the coils, of direct oil fill, and to the rocker arms. The coil bracket permits removal of all coils for independent checking, replacement or servicing simply by removal of two bolts, while the rocker arm chamber remains intact and undisturbed. In addition, the coils are maintained dry and protected by not being in the wet chamber along with the rocker arms. Thus, the inventive RAC assembly has the clear potential of becoming adopted as the new standard for apparatus and methods of co-mounting coils of DIS systems and rocker arm covers in a single, robust unit.

It should be understood that various modifications within the scope of this invention can be made by one of ordinary skill in the art without departing from the spirit thereof and without undue experimentation. For example, the longitudinal base housing can have a wide range of configurations to provide different engine head designs the functionalities disclosed herein. In addition, the improved, inventive RAC unit may be fitted with two conduits, e.g., one at each end, with one fitted to function as an oil fill tube and the other fitted with a PCV valve. This invention is therefore to be defined by the scope of the appended claims as broadly as the prior art will permit, and in view of the specification if need be, including a full range of current and future equivalents thereof.

The invention claimed is:

1. An improved combined ignition coil and rocker arm cover assembly for internal combustion engines having Distributorless Ignition Systems, said assembly being mountable to the head of said internal combustion engines, comprising in operative combination:

a. an elongated, longitudinally extending, open-bottom shell housing, having generally an inverted-U shape in vertical cross-section, a pair of spaced vertical longitudinally extending side walls that are joined at each end by end walls that are continuations of and join the respective side walls, the bottom of said side walls being configured to sealingly engage the head of an internal combustion engine in mounted position;

b. said shell housing having a horizontal partition wall spanning between said vertical side walls and disposed medially between the open bottom and a flattened top of said housing;

c. said partition dividing said housing into an upper coil chamber and a lower rocker arm chamber to provide a "coil-over" mounting arrangement;

d. said upper coil chamber being divided into a removable lid member and a coil mounting recess along a parting line disposed medially between said partition and the surface of said lid;

e. said upper coil chamber including a plurality of apertures in one longitudinal side wall through which plug wires may be fed to coils mounted in said coil chamber;

f. a coil mounting bracket configured to receive a plurality of coils mounted in generally parallel relationship thereon so that coil sockets can be directly accessed and engaged with plug wires through said side wall apertures;

g. said side wall apertures being disposed in said side wall so that said apertures are substantially horizontally and medially split by said partition line such that approximately half the aperture is in the lid and half is in the coil recess side wall above said horizontal partition wall h. a pair of upstanding bosses disposed extending upwardly from said horizontal partition wall adjacent opposed longitudinal ends of said coil mounting recess, said bosses being threaded to receive mounting screws for securing said coil mounting bracket thereto; and i. a conduit extending from an aperture in said lid through said coil chamber and exiting through said horizontal partition, said conduit being isolated from said coil chamber and providing dual function of oil fill and crankcase vapor exhaust.

2. An improved coil and rocker arm cover assembly as in claim 1 wherein said lid includes a plurality of mounting holes and mounting screws, said coil bracket includes the same plurality of holes corresponding to and aligned therewith for receiving said mounting screws so that said lid is secured to said coil bracket.

3. An improved coil and rocker arm cover assembly as in claim 1 wherein said partition line includes cooperatingly aligned lip and shoulders in the side walls of said lid and said coil recess to provide alignment and seal.

4. An internal combustion engine having a V8 configuration of two blocks of 4 cylinders, a cylinder head for each block, and a coil and rocker arm cover of claim 1 secured to each head.

5. An improved coil and rocker arm cover assembly as in claim 1 wherein said horizontal partition wall includes a plurality of holes for receiving mounting bolts, said holes are cooperatingly aligned with threaded mounting holes in said engine head so that said assembly is mountingly secured to said head by bolts through said holes in said partition wall.

6. An improved coil and rocker arm cover assembly as in claim 5 wherein the rocker arm chamber side of said horizontal partition wall includes bosses through which said mounting holes pass.

7. An improved coil and rocker arm cover assembly as in claim 1 wherein said conduit comprises a crankcase vapor passage and which includes a PCV valve communicating with an air intake air manifold of said engine disposed in said crankcase vapor passage.

8. An improved coil and rocker arm cover assembly as in claim 7 wherein said crankcase vapor passage conduit includes threads into which a PCV valve may be screwed.

9. An improved coil and rocker arm cover assembly as in claim 1 which includes an aperture for in-feed of signal or power to said coils disposed to inlet in said coil chamber in a vertical longitudinal side wall thereof.

10. An improved coil and rocker arm cover assembly as in claim 9 wherein said in-feed aperture is disposed in the coil chamber side wall opposite said plurality of coil socket apertures.

11. An improved coil and rocker arm cover assembly as in claim 10 wherein said in-feed aperture is horizontally split by said parting line.

12. An improved coil and rocker arm cover assembly as in claim 1 wherein the marginal edge of said open bottom includes a groove for receiving a seal member to assist in sealing said assembly to said engine head.

13. An improved coil and rocker arm cover assembly as in claim 12 which includes a lip depending from at least a portion of said marginal edge of said open bottom to assist in alignment of said assembly to said engine head.

14. An improved coil and rocker arm cover assembly as in claim 13 wherein said alignment lip extends along at least a portion of the bottom marginal edge of said vertical side wall in which said apertures are located.

15. An improved coil and rocker arm cover assembly as in claim 14 wherein said lip extends at least part way around transverse end wall joining said longitudinal side walls.

16. An improved coil and rocker arm cover assembly as in claim 1 wherein said conduit comprises an oil fill tube and which includes a closure cap having a stem for sealingly engaging said oil fill tube to permit adding oil directly to said rocker arm chamber without removal of said coil chamber lid.

17. An improved coil and rocker arm cover assembly as in claim 16 wherein said oil fill tube includes a tang that cooperatingly engages a bayonet slot in said cap stem to cammingly tighten said cap down onto the top of said cover assembly.

18. An improved coil and rocker arm cover assembly as in claim 17 wherein said cap includes an O-ring seal that sealingly engages a shoulder adjacent the inlet end of said oil fill tube.

19. An internal combustion engine as in claim 4 wherein one of said rocker arm covers has an oil fill tube and the other has a crankcase vapor passage.

20. An internal combustion engine as in claim 19 wherein each improved coil and rocker arm cover assembly includes an aperture for in-feed of signal or power to said coils disposed to inlet in said coil chamber in a vertical longitudinal side wall thereof.

* * * * *